US009182745B2

(12) United States Patent
Mertenat

(10) Patent No.: US 9,182,745 B2
(45) Date of Patent: Nov. 10, 2015

(54) MECHANICAL ADJUSTMENT OF THE SHAKE OF A TIMEPIECE WHEEL SET

(71) Applicant: ETA SA Manufacture Horlogere Suisse, Grenchen (CH)

(72) Inventor: Olivier Mertenat, Solothurn (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/303,667

(22) Filed: Jun. 13, 2014

(65) Prior Publication Data

US 2014/0369173 A1 Dec. 18, 2014

(30) Foreign Application Priority Data

Jun. 14, 2013 (EP) ..... 13171980

(51) Int. Cl.
*G04B 29/02* (2006.01)
*G04B 35/00* (2006.01)

(52) U.S. Cl.
CPC ..... *G04B 29/02* (2013.01); *G04B 29/025* (2013.01); *G04B 35/00* (2013.01)

(58) Field of Classification Search
CPC ..... G04B 29/02; G04B 35/00; G04B 15/00; G04B 12/12; G04B 29/04; G04B 29/00; G04B 31/00; G04B 15/12
See application file for complete search history.

(56) References Cited

U.S. PATENT DOCUMENTS

| | | | | |
|---|---|---|---|---|
| 2,675,732 | A * | 4/1954 | Angst | 411/338 |
| 3,393,506 | A * | 7/1968 | Garbe | 368/173 |
| 3,483,693 | A * | 12/1969 | Smythe, Jr. | 368/173 |
| 3,853,312 | A * | 12/1974 | Saito | 267/152 |
| 2007/0147180 | A1* | 6/2007 | Rufenacht et al. | 368/184 |
| 2007/0159931 | A1* | 7/2007 | Rufenacht et al. | 368/294 |
| 2012/0134242 | A1* | 5/2012 | Wyssbrod | 368/76 |
| 2013/0051190 | A1* | 2/2013 | Villar et al. | 368/132 |

FOREIGN PATENT DOCUMENTS

| | | |
|---|---|---|
| CH | 23 837 | 9/1902 |
| CH | 503 308 | 10/1970 |
| CH | 705 087 A2 | 12/2012 |
| FR | 1 545 748 | 11/1968 |

OTHER PUBLICATIONS

European Search Report issued Jan. 21, 2014 in EP Application 13171980, filed on Jun. 14, 2013 ( with English Translation).

* cited by examiner

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

A timepiece movement for a watch, including a main plate and a bar holding a wheel set in a reference position, and a device to adjust the height of this bar in relation to the plate in the direction of the axis of rotation of the wheel set, at a first point remote from the reference position, and this height adjustment device includes a screw or a worm rotatably movable about an oblique control axis in relation to the axis of rotation, and a cone or a curved surface for transforming motion between this screw or worm and a pusher movable in a parallel direction to the axis of rotation.

24 Claims, 5 Drawing Sheets

MECHANICAL ADJUSTMENT OF THE SHAKE OF A TIMEPIECE WHEEL SET

This application claims priority from European Patent Application No. 13171980.9 filed Jun. 14, 2013, the entire disclosure of which is incorporated by reference.

FIELD OF THE INVENTION

The invention concerns a timepiece movement including at least a main plate and a bar for holding a wheel set on both sides, a bottom pivot of which occupies a reference position on said main plate, wherein said movement includes a means of adjusting the height of at least a first point of said bar in relation to said plate in the direction of the axis of rotation of said wheel set, said first point being, in projection onto a reference plane of said plate orthogonal to said axis of rotation of said wheel set, at a first non-zero distance from said reference position.

The invention also concerns a watch including at least one movement of this type.

The invention concerns the field of mechanical precision instruments, and more specifically the field of horology. It particularly concerns timepiece movements including wheel sets pivoted between two structural elements.

BACKGROUND OF THE INVENTION

Adjusting the shake of a timepiece wheel set pivoted between two structural elements, particularly between a plate and a bar, also called a cock in the case of a bar for a balance, often optimises the operation of the wheel set and the performance of the movement in which it is integrated. Often, this shake is not adjustable, and results from manufacturing tolerances and operating plays. To overcome this lack of adjustment range, the experienced watchmaker knows how to perform a local deformation of one of the components of the assembly, the least rigid component, for example the cock, to perform a shake adjustment, for example with an amplitude of 20 to 40 micrometers for a balance shake adjustment at T1.

This operation is complex, approximate, costly in terms of time, requires highly skilled personnel, is not reproducible and cannot be automated.

The other option consists in manually modifying the relative position of a bar with respect to a main plate, and particularly modifying the position of a shock absorber bearing holder comprised in the plate, with respect to the bar or vice versa, which requires driving out an element and, as in the case above, results in an effect on the holding force of the shock absorber and/or a deformation of at least one of the components, which is undesirable.

A mechanical adjustment is thus preferred, since it makes it possible to solve problems of reproducibility, is accessible to less highly qualified personnel, and can be automated. However, the space available inside a calibre is not generally sufficient to house an additional adjustment mechanism, especially in the direction of the thickness of the movement in which this type of shake adjustment generally has to be performed.

FR Patent No 1545748 in the name of THE UNITED STATES TIME CORPORATION discloses a device for axially adjusting a balance cock with respect to a main plate, with a cam element whose axis is perpendicular to the plate, including an eccentric head cooperating with a sloping bottom surface of the cock to adjust the position of the latter. This device includes position locking means.

CH Patent Application No 705087A2 in the name of HUBLOT SA describes a member for adjusting the distance between the cock and the plate, provided with an externally threaded part screwed into the cock and including a toothed wheel.

SUMMARY OF THE INVENTION

The invention proposes to create a mechanical means of adjusting the shake of a timepiece wheel set in a movement, without altering the dimensions of the movement, so as to easily transform an existing movement at lower cost, by acting on the smallest possible number of components, and with simple machining operations. The adjustment according to the invention is also devised to be easy to automate.

The invention therefore concerns a timepiece movement including at least one main plate and one bar for holding a wheel set on both sides, a bottom pivot of which occupies a reference position on said plate, wherein said movement includes a means of adjusting the height of at least a first point of said bar with respect to said plate in the direction of the axis of rotation of said wheel set, said first point being, in projection onto a reference plane of said plate orthogonal to said axis of rotation of said wheel set, at a first non-zero distance from said reference position, characterized in that said height adjustment means includes control means rotatably movable about an oblique control axis relative to said axis of rotation of said wheel set, and including a means of transforming motion between said control means and a pusher movable in a parallel direction to said axis of rotation of said wheel set.

The invention also concerns a watch including at least one movement of this type.

BRIEF DESCRIPTION OF THE DRAWINGS

Other features and advantages of the invention will appear upon reading the following detailed description, with reference to the annexed drawings, in which:

FIG. 8 is a schematic, partial cross-section of the movement in a plane passing through the axis of an externally threaded pusher, which is driven by the internal thread of a crown whose external toothing meshes with a worm, which forms the control means, the cross-sectional plane being perpendicular to the axis of said worm.

FIG. 9 is a schematic top view, with the bar removed, of the mechanism of FIG. 8 fitted to the plate.

FIG. 10 is a schematic top view of the plate in the area where the mechanism is placed.

DETAILED DESCRIPTION OF PREFERRED EMBODIMENTS

Figure 1:
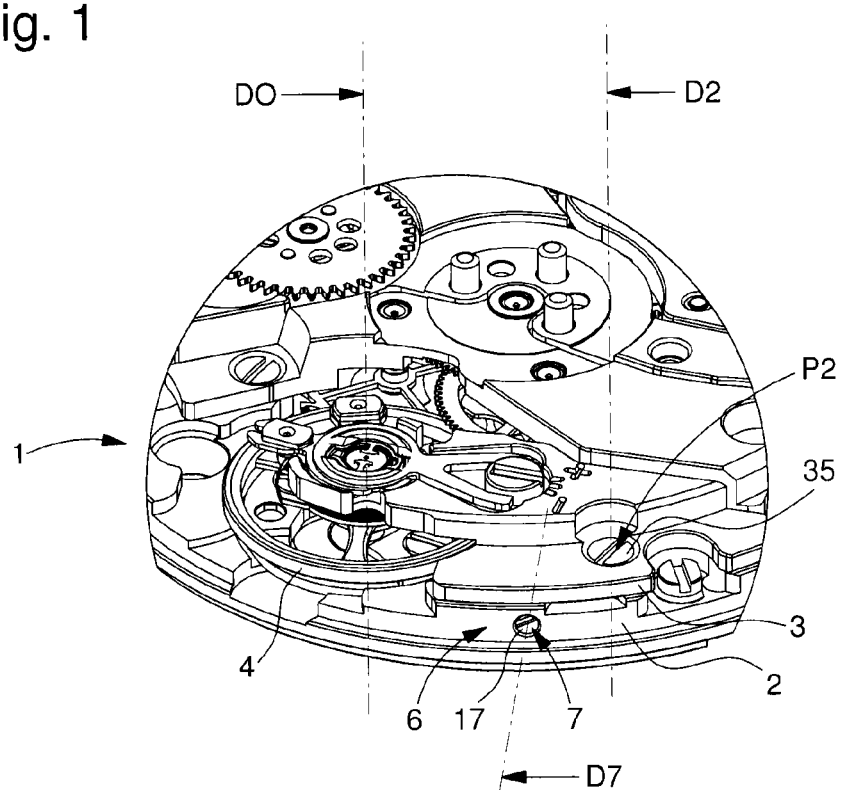
FIG. 1 shows a schematic, partial, perspective view of a timepiece movement, more specifically a watch movement, with a balance held between a plate and a balance bar, also called a cock, said bar being adjustable in relation to said plate according to a first embodiment of the invention seen in FIGS. 1 to 7, with, at the periphery of the plate closest to the observer, a radial screw belonging to control means for the cock height adjustment means according to the invention, said cock is held clamped on the plate by a nearby screw, and has a parallel axis to that of the balance.
Figure 2:
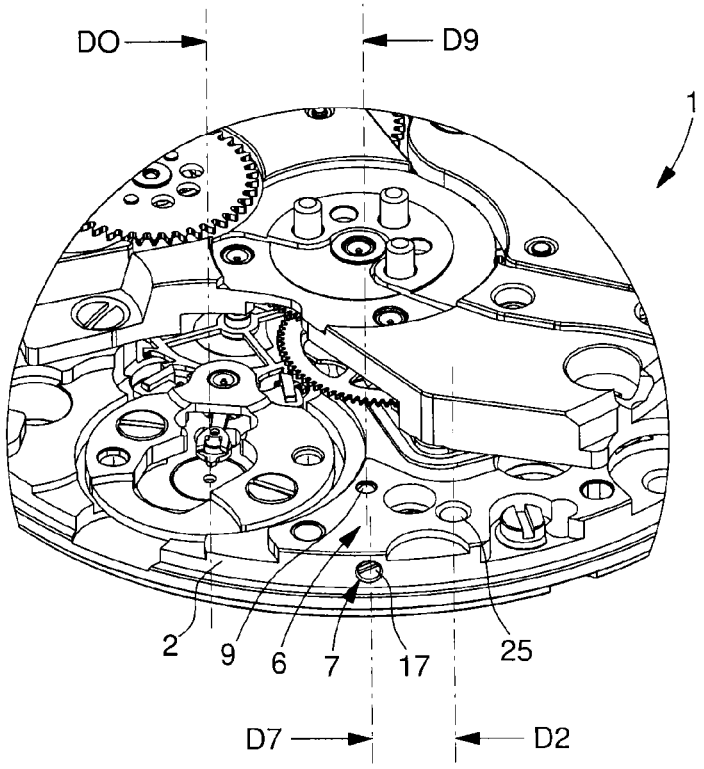
FIG. 2 shows, in a similar manner, the same movement after the cock and the balance have been removed, and a ball forming a pusher for adjusting the height of the cock is visible in the axis of said radial adjustment screw.
Figure 3:
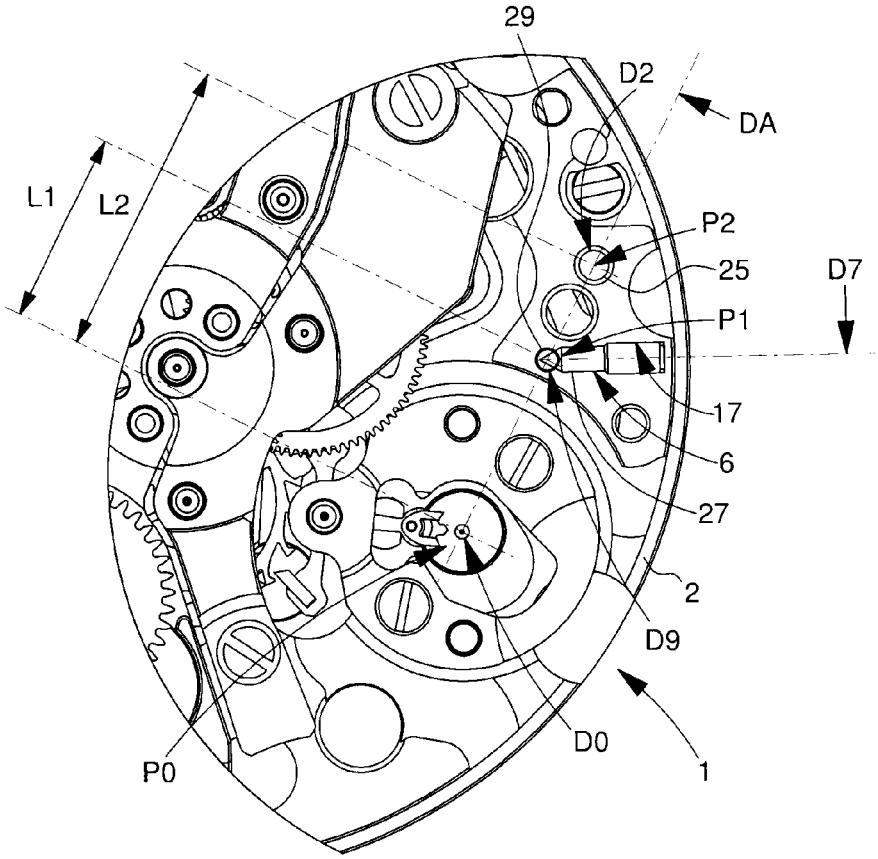
FIG. 3 is a schematic top view of the same area of the movement showing only the plate and machined areas for receiving the control means, height adjustment means and securing means.

The invention concerns the field of timepiece movements including wheel sets pivoted between two structural elements, for which axial adjustment is advantageous. More specifically, the invention concerns the field of regulating mechanisms.

Although the invention is more specifically described here for the adjustment of the axial shake of a balance, it is clear that the master watchmaker will know how to apply it to the axial adjustment of other wheel sets having the same type of assembly.

A "wheel set" means here any timepiece component mounted to be pivotally movable. The Figures illustrate a particular case where the wheel set is a balance.

The invention concerns a timepiece movement 1 including at least one plate 2 and a bar 3 for holding a wheel set 4 on both sides, particularly a balance in which case bar 3 of the balance is also called a cock. A bottom pivot 5 of wheel set 4 occupies a reference position P0 on plate 2.

Movement 1 includes height adjustment means 6 for at least a first point P1 of bar 3 in relation to plate 2 in a parallel direction to the direction of axis of rotation D0 of wheel set 4.

This first point P1 is, in projection onto a reference plane PR of plate 2 orthogonal to axis of rotation D0 of wheel set 4, at a first, non-zero distance L1 from this reference position P0.

According to the invention, height adjustment means 6 includes a control means 7, which is rotatably movable about an oblique control axis D7 relative to the direction of axis of rotation D0 of wheel set 4. This height adjustment means includes motion transforming means 8 between control means 7 on the one hand, and on the other hand, a pusher 9 movable in a direction D9 parallel to axis of rotation D0 of wheel set 4. In a particular embodiment, pusher 9 is magnetic, as is control means 7, having polarities tending to attract them to each other in the assembled operating position, without the magnetic field interfering with the escapement.

A first embodiment of the invention is illustrated in FIGS. 1 to 7.

Figure 4:
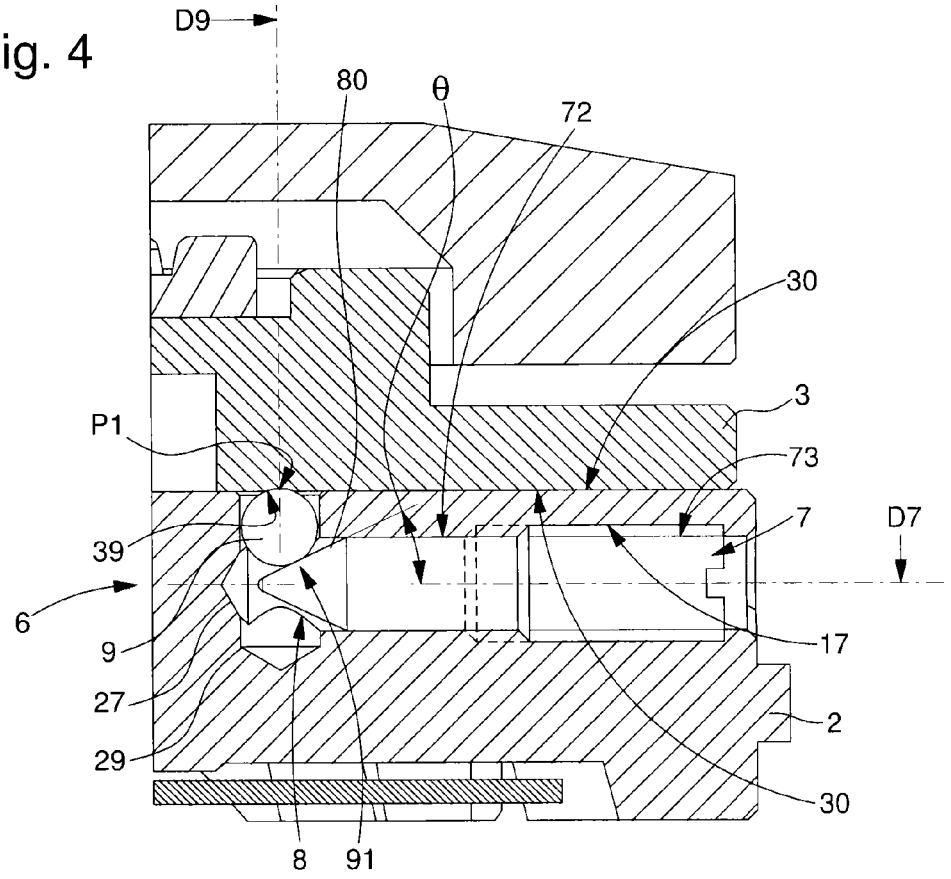
FIG. 4 is a schematic, partial cross-section of the movement in proximity to the control means for the cock height adjustment means, in a parallel plane to the axis of the balance and passing through the axis of the radial screw belonging to the control means.
Figure 5:
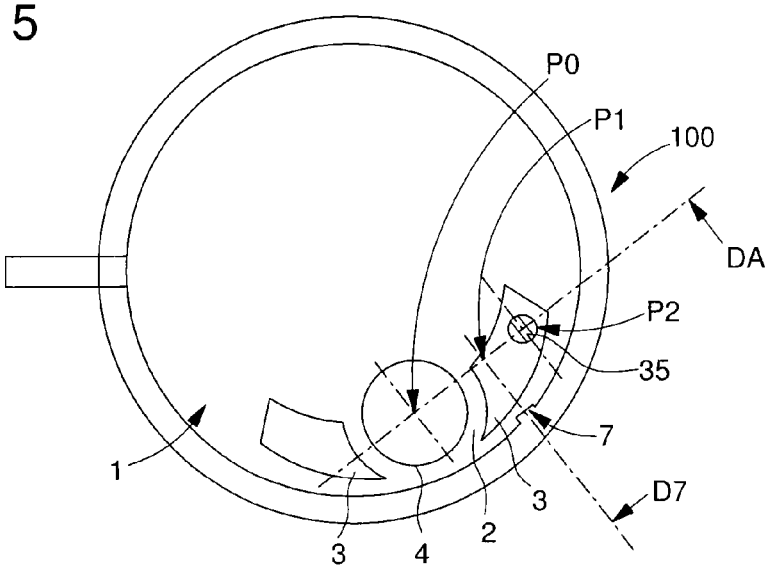
FIG. 5 shows a schematic, partial, top view of a watch including a movement of this type.
Figure 7:
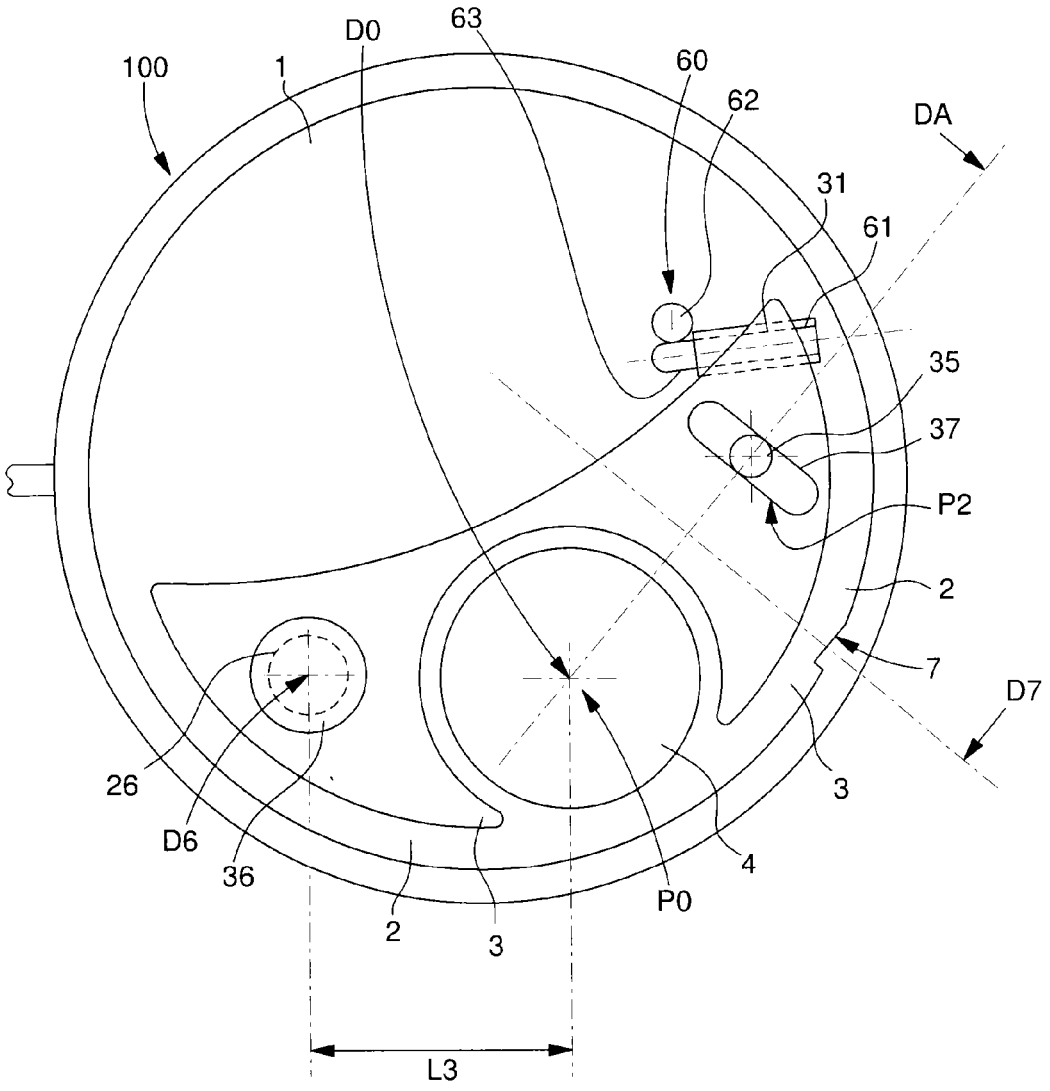
FIG. 7 shows, in a similar manner to FIG. 5, a watch including a movement according to the invention and which also includes an angular adjustment of the cock in relation to the plate.

As seen in FIG. 4, control means 7 cooperates with a complementary means 17 arranged in a first housing 27 in plate 2.

In a particular embodiment, control means 7 is formed by a radial screw whose external thread cooperates with an inner thread forming complementary means 17, arranged in a first housing 27, which is a long pierced recess here, comprised in plate 2.

Control means 7 includes, as shown in FIG. 4, motion transforming means 8 in the form of a cone 80 or a curved surface.

Preferably, control axis D7 has an orthogonal direction to that of axis of rotation D0 of wheel set 4.

Pusher 9 also includes a surface 91, which is spherical or curved or even conical if surface 80 is spherical or curved, which cooperates with motion transforming means 8.

In the non-limited example of FIG. 4, screw 7 has a conical end, which cooperates with a spherical cap of pusher 9, which is preferably made in the form of a ball. The equilibrium diagram of this ball in cooperation with surface 80 is drawn to avoid any butting. For example, a pusher 9 formed of a ball having a diameter of 0.40 mm cooperates with a cone 80 having a 30° half angle at the apex e at the end of a screw 7 guided on a cylindrical shoulder 72 having a diameter of 0.6 mm; this cone-pointed set screw 7 has an external thread 73 with a pitch of between 0.11 and 0.15 mm, which provides good sensitivity.

Plate 2 includes a guide housing 29 for pusher 9, along a rectilinear axis D9 substantially parallel to axis of rotation D0 of wheel set 4.

In a particularly economical embodiment, it is thus possible to transform an existing plate simply by machining two secant pierced holes, one axial and the other radial, radial pierced hole 27 being threaded with an internal thread 17 receiving screw 7 and axial pierced hole 29 forming the guide member for a simple ball 9.

This pusher 9, or ball, may be supported directly on a bottom surface of bar 3, which does not then need to be re-machined, for the purpose of converting an existing movement. In a variant, the pusher may be supported on a receiving surface 39 on the cock: a spherical or conical cavity, groove or similar, for receiving the end of pusher 9 which is opposite motion transforming means 8.

The end of pusher 9, which cooperates with adjustment means 7, preferably still projects above the top surface 20 of plate 2 facing the bottom surface 30 of bar 3, so as to allow adjustment by moving bar 3 and plate 2 further away or closer.

Figure 6:
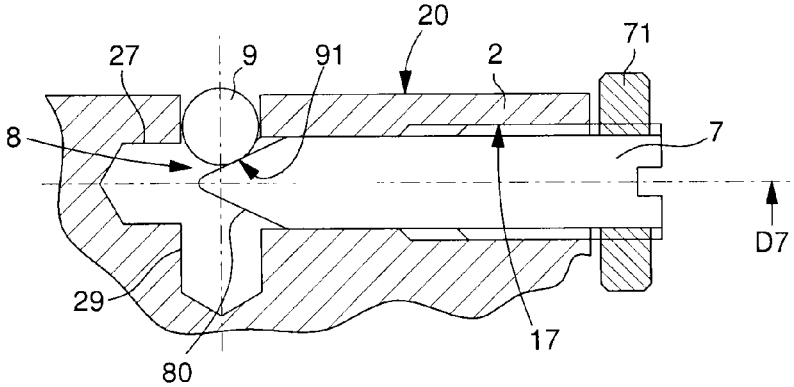
FIG. 6 shows, in a similar manner to FIG. 4, a cross-section of the plate fitted with a radial adjustment screw provided with arresting means in the form of an external lock nut.

In a particular variant, as seen in FIG. 6, control means 7 includes arresting means 71, which is arranged to cooperate with plate 2 to lock control means 7 in position after adjustment in relation to plate 2 along control axis D7. In a particular version, this arresting means 71 includes at least one lock nut (mounted on the screw when control means 7 includes a screw as in the present case), or at least one spring, helical spring or snap ring, or similar.

Bar 3 may, depending on the embodiment of movement 1, surround wheel set 4 on both sides of its axis of rotation D0, or be cantilevered on a single side of axis D0; in this configuration, the term "through balance bar" is used. High quality clamping is required to secure bar 3 on plate 2 and to position the bar properly in relation to the plate, which is preferably achieved by at least one clamping means such as a screw, and at least one positioning reference, such as a screw with a pivot shoulder, centring pin or similar. Preferably, the positioning reference includes a centring element, such as a pivot or pin in a boss or a bore, or vice versa, and an alignment element, such as a pin in a hole aligned with the centring element or vice versa. Regardless of whether a cock or a cross balance bar is used, the centring and alignment system remains the same.

In the version illustrated by the Figures, movement 1 includes a tightening screw 35 cooperating with an internal thread 25 of plate 2, along a rectilinear axis D2 substantially parallel to axis of rotation D0 of wheel set 4, for tightening bar 3 in abutment on pusher 9. This internal thread 25 is positioned in a position P2, at a second non-zero distance L2 from reference position P0 of wheel set 4. Preferably, this second distance L2 is different from first distance L1. In a preferred version illustrated in the Figures, rectilinear axis D9 of housing 29 and rectilinear axis D2 of internal thread 25 are coplanar with axis of rotation D0 of wheel set 4.

In a particular variant, movement 1 includes a pivot screw 36 cooperating with an internal thread 26 of plate 2 along a rectilinear pivot axis D6 substantially parallel to axis of rotation D0 of wheel set 4 to allow an angular adjustment of bar 3 in relation to plate 2 about this rectilinear pivot axis D6, and for clamping bar 3 on plate 2 in a determined angular position. This internal thread 26 is positioned at a third, non-zero distance L3 from reference position P0. In this same variant, movement 1 preferably includes micrometric angular adjustment means 60 for the relative angular adjustment of bar 3 with respect to plate 2. When bar 3 has a receiving surface 39 for pusher 9, said receiving surface 39 is advantageously limited by stop surfaces which limit the angular travel of relative angular adjustment of bar 3 in relation to plate 2, and tightening screw 35 is supported on a plane surface of bar 3, or in a plane groove 37 of bar 3 delimited by stop surfaces. In a particular example, micrometric angular adjustment means 60 includes a screw 61 housed inside a substantially radial internal thread 21 of plate 2, or respectively in a substantially radial internal thread 31 of bar 3, and screw 61 is arranged to push or pull a finger 62 integral with bar 3, or respectively with plate 2, for example in a groove 63 comprised in screw 61 or similar.

Figure 8:
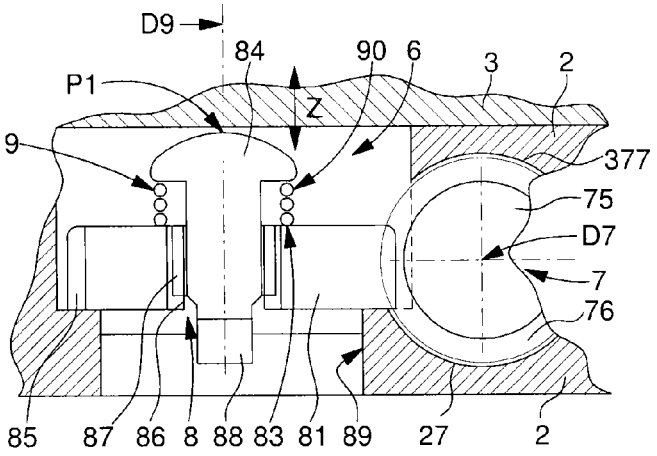
FIGS. 8 to 10 illustrate a second embodiment of the invention, for which FIGS. 5 and 7 remain valid.
Figure 9:
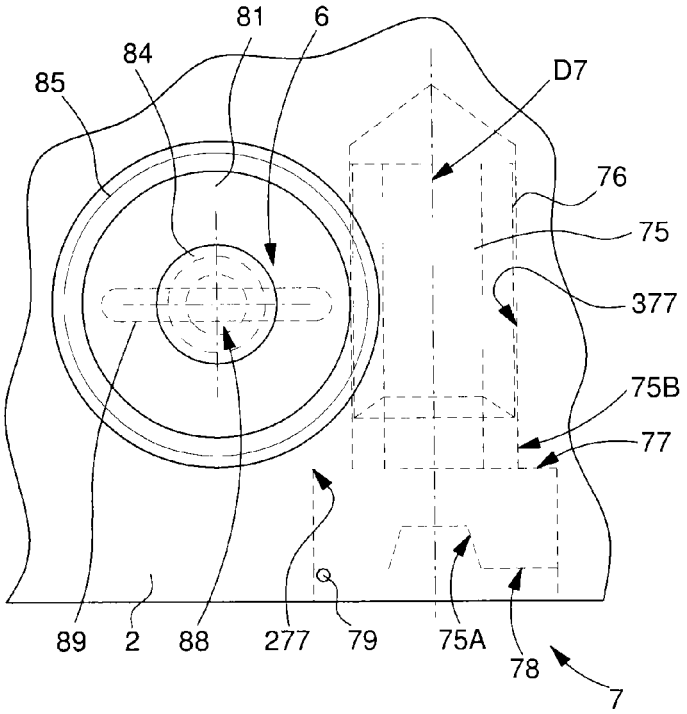
Figure 10:
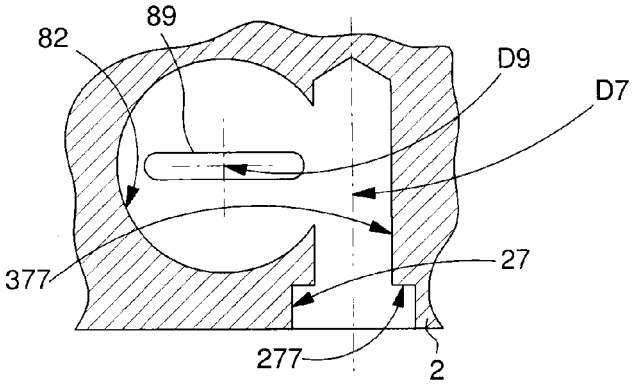

In a variant, as seen in FIGS. 8 to 10, the transmission of motion occurs via a screw jack: control means 7 is formed by a worm 75 which is guided in first housing 27 formed by at least one smooth shoulder in at least one bore of plate 2, in which said worm 75 is axially stopped, on one side by a shoulder 77 of worm 75, which cooperates with a shoulder 277 of plate 2, and on the other side by a pin 79 driven into plate 2 after the assembly of worm 75, to lock face 78 thereof.

Worm 75 drives a crown 81 confined in a blind bore 82 of plate 2, in which it is enclosed by the head 83 of a pusher 84 which forms pusher 9. Crown 81 includes an external toothing 85 which cooperates with worm 75 and an internal thread 86, which cooperates with an external thread 87 of pusher 84. This pusher includes two flat portions 88 which lock it in rotation in an oblong hole 89 of plate 2. Consequently, pusher 84 is movable in direction Z of axis D9 common to crown 81 and to pusher 84 when worm 75 is operated, for example via a tool in a slot 75A.

In an advantageous variant, prestressing by prestressing means 90, represented in the form of a helical spring in FIG. 8, makes it possible to reduce plays between the external-internal threads and between the toothings, and to press pusher 84 fully against bar 3.

Preferably, worm 75 includes a cylindrical shoulder 75B for the guiding thereof in a bore 377 of plate 2.

It is easy to mount the assembly: first of all pusher 84 is mounted in crown 81, they are placed in their housing 82, indexing pusher 84 so as to guide flat portions 88 thereof in oblong groove 89, then worm 75 is screwed in and placed in a stop position on face 277 of plate 2, stop pin 79 is then driven in, before bar 3 is set in place.

Movement 1 according to the invention is devised to be easy to adjust at the moment of poising, and therefore control means 7 is preferably located at the periphery of plate 2 and is accessible after assembly of the complete movement 1. Likewise, when movement 1 includes micrometric angular adjustment means 60, this means is also located at the periphery of plate 2 or of bar 3, and is accessible after assembly of the complete movement 1.

The invention also concerns a watch 100 including at least one movement 1 of this type.

The invention therefore makes it possible to avoid any deformation of the cock, to reuse existing components by simple machining operations, to add only very simple components such as balls, screws or similar, to perform precise, fast, reproducible and automated shake adjustments, owing to accessibility of a cone pointed set screw at the periphery of the plate. Further, the design incorporated in the thickness of the plate (or of the plate and of the cock) means that there are no elements inserted in proximity to the wheel set whose shake requires adjustment, capable of interfering or colliding with a neighbouring component or the actual wheel set.

The mechanism is simple, easy to integrate into existing movements and provides high adjustment power.

What is claimed is:

1. A timepiece movement, comprising:

at least a main plate and a bar for holding a wheel set on both sides, a bottom pivot of which occupies a reference position on said plate; and means of adjusting the height of at least a first point of said bar in relation to said plate in the direction of the axis of rotation of said wheel set, said first point being, in projection onto a reference plane of said plate orthogonal to said axis of rotation of said wheel set, at a first non-zero distance from said reference position, wherein said height adjustment means includes control means rotatably movable about a control axis, the control axis being oblique or orthogonal relative to said axis of rotation of said wheel set, and said height adjustment means includes a means of transforming motion between said control means and a pusher movable in a parallel direction to said axis of rotation of said wheel set, said pusher being in abutment directly on a bottom surface of said bar, and wherein said control means is located at a periphery of said plate and is accessible after said movement is completely assembled.

2. The movement according to claim 1, wherein said control means cooperates with a complementary means arranged in a first housing in said plate.

3. The movement according to claim 2, wherein said control means is formed by a screw whose external thread cooperates with an internal thread forming said complementary means arranged in a first housing in said plate.

4. The movement according to claim 1, wherein said control means includes said motion transforming means in the form of a cone or a curved surface.

5. The movement according to claim 1, wherein said pusher includes a spherical or curved surface which cooperates with said motion transforming means.

6. The movement according to claim 1, wherein said bar includes a receiving surface for an end of said pusher which is opposite to said motion transforming means.

7. The movement according to claim 1, wherein said plate includes a housing for guiding said pusher along a rectilinear axis substantially parallel to said axis of rotation of said wheel set.

8. The movement according to claim 7, wherein the movement includes a tightening screw cooperating with an internal thread of said plate along a rectilinear axis substantially parallel to said axis of rotation of said wheel set to clamp said bar in abutment on said pusher, said internal thread being positioned at a second non-zero distance from said reference position, wherein said second distance is different from said first distance and wherein said rectilinear axis of said housing and said rectilinear axis of said internal thread are coplanar to said axis of rotation of said wheel set.

9. The movement according to claim 1, wherein said control means includes arresting means arranged to cooperate with said plate to lock said control means in position after adjustment in relation to said plate along said control axis.

10. The movement according to claim 9, wherein said arresting means includes at least one lock nut or at least one spring.

11. The movement according to claim 1, wherein the movement includes a tightening screw cooperating with an internal thread of said plate along a rectilinear axis substantially parallel to said axis of rotation of said wheel set to clamp said bar in abutment on said pusher, said internal thread being positioned at a second non-zero distance from said reference position.

12. The movement according to claim 11, wherein said second distance is different from said first distance.

13. The movement according to claim 1, wherein the movement includes a pivot screw cooperating with an internal thread of said plate along a rectilinear pivot axis substantially parallel to said axis of rotation of said wheel set, to allow an angular adjustment of said bar in relation to said plate about said rectilinear pivot axis, and for clamping said bar in abutment in a determined angular position on said plate, said internal thread being positioned at a third non-zero distance from said reference position.

14. The movement according to claim 13, wherein the movement includes micrometric angular adjustment means for the relative angular adjustment of said bar in relation to said plate.

15. The movement according to claim 14, wherein said bar includes a receiving surface for the end of said pusher which is opposite to said motion transforming means and wherein said receiving surface of said pusher is limited by stop surfaces limiting the angular travel of relative angular adjustment of said bar in relation to said plate.

16. The movement according to claim 14, wherein said micrometric angular adjustment means includes a screw housed in a substantially radial internal thread of said plate, or respectively in a substantially radial internal thread of said bar, said screw being arranged to push or pull a finger integral with said bar, or respectively with said plate.

17. The movement according to claim 14, wherein said micrometric angular adjustment means is located at the periphery of said plate or of said bar, and is accessible after assembly of said complete movement.

18. The movement according to claim 1, wherein said pusher is magnetic, as is said control means, having polarities that tend to attract said pusher and control means to each other in an assembled operating position.

19. The movement according to claim 1, wherein the transmission of motion occurs via a screw jack, said control means being formed by a worm, which is guided in said first housing in which said worm is axially arrested, said worm driving an external toothing of a crown confined inside a blind hole of said plate, said crown including an internal thread cooperating with an external thread of said pusher which is free to move in translation but is locked in rotation.

20. The movement according to claim 19, wherein the movement includes a prestressing means or a helical spring for pressing said pusher against said plate.

21. The movement according to claim 1, wherein said wheel set is a balance wheel.

22. A watch including at least one movement according to claim 1.

23. The movement according to claim 1, wherein said pusher is a ball.

24. A timepiece movement, comprising:

at least a main plate and a bar for holding a wheel set on both sides, a bottom pivot of which occupies a reference position on said plate; and means of adjusting the height of at least a first point of said bar in relation to said plate in the direction of the axis of rotation of said wheel set, said first point being, in projection onto a reference plane of said plate orthogonal to said axis of rotation of said wheel set, at a first non-zero distance from said reference position, wherein said height adjustment means includes control means rotatably movable about a control axis, the control axis being oblique or orthogonal relative to said axis of rotation of said wheel set, and said height adjustment means includes a means of transforming motion between said control means and a pusher movable in a parallel direction to said axis of rotation of said wheel set, and wherein the movement includes a pivot screw cooperating with an internal thread of said plate along a rectilinear pivot axis substantially parallel to said axis of rotation of said wheel set, to allow an angular adjustment of said bar in relation to said plate about said rectilinear pivot axis, and for clamping said bar in abutment in a determined angular position on said plate, said internal thread being positioned at a third non-zero distance from said reference position.

* * * * *